US008507166B2

(12) United States Patent
Lofftus et al.

(10) Patent No.: US 8,507,166 B2
(45) **Date of Patent: *Aug. 13, 2013**

(54) SURFACE TREATED TONER

(75) Inventors: Kevin D. Lofftus, Fairport, NY (US); Peter S. Alexandrovich, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 195 days.

This patent is subject to a terminal disclaimer.

(21) Appl. No.: 13/173,183

(22) Filed: Jun. 30, 2011

(65) Prior Publication Data

US 2012/0308923 A1 Dec. 6, 2012

Related U.S. Application Data

(60) Provisional application No. 61/491,521, filed on May 31, 2011.

(51) Int. Cl.
*G03G 9/08* (2006.01)

(52) U.S. Cl.
USPC ..... 430/108.6; 430/106.1

(58) Field of Classification Search
USPC ..... 430/108.6, 106.1
See application file for complete search history.

(56) References Cited

U.S. PATENT DOCUMENTS

| | | | |
|---|---|---|---|
| 5,066,558 | A | 11/1991 | Hikake et al. |
| 6,087,057 | A | 7/2000 | Hakata et al. |
| 6,582,866 | B2 | 6/2003 | Kumar et al. |
| 7,601,473 | B2 | 10/2009 | Lofftus et al. |
| 2012/0308924 | A1 | 12/2012 | Lofftus et al. |

*Primary Examiner* — Mark A Chapman
(74) *Attorney, Agent, or Firm* — Andrew J. Anderson

(57) ABSTRACT

A toner composition includes resin core particles having outer surfaces, and surface treatment, wherein the surface treatment includes at least first metal oxide particles having a surface area equivalent average particle diameter of greater than 25 nm and a surface energy of less than 28 erg/cm$^2$, as determined by methanol wettability midpoint at 22° C., tacked to the outer surfaces of the resin core particles, at a concentration to provide a total projected area of the first metal oxide particles sufficient to cover at least 10% of the resin core particle outer surfaces area, and wherein the toner composition comprises less than 0.013 g non-tacked surface treatment per square meter of resin core particles outer surface. A developer for developing electrostatic images includes magnetic carrier particles and toner as described above, wherein the developer comprises less than 0.013 g non-tacked surface treatment per square meter of resin core particles outer surface, that is free to transfer between the outer surface of the resin core particles and outer surfaces of the magnetic carrier particles.

20 Claims, No Drawings

SURFACE TREATED TONER

CROSS-REFERENCE TO RELATED APPLICATIONS

This application claims the benefit of U.S. Provisional Patent Application No. 61/491,521, filed May 31, 2011, the disclosure of which is incorporated by reference herein in its entirety.

Reference is made to commonly assigned U.S. patent application Ser. No. 13/173,271 filed concurrently herewith, directed towards "Process for Adhering Surface Treatment to Toner," the disclosure of which is incorporated by reference herein in its entirety.

FIELD OF THE INVENTION

The present invention relates to toners for electrophotography. The present invention provides improved toner performance through improved surface treatment.

BACKGROUND OF THE INVENTION

Surface forces and charging properties of toners are modified by application of fine particulate surface treatments. The most common surface treatments are surface modified fumed silica powders, but fine particles of titania, alumina, zinc oxide, tin oxide, cerium oxide, and polymer beads can also be used. Surface treatment may serve other functions such as providing cleaning aids to ancillary processing in an electrophotographic process.

Surface treatments are used to reduce surface forces for improved powder flow and transfer efficiency. High transfer efficiencies are not only desirable for yield but also for improved image quality by minimizing transfer variation sources of density non-uniformities. Variations in transfer can be thought of as acting upon the untransferred or residual toner. Obviously, non-uniformities due to poor transfer are reduced by improved transfer. Additionally, high transfer variations from such sources as fuser oil and vibrations that induce shear transfer have less residual to act upon to generate density non-uniformities.

Many aspects of surface treatment are spelled out in U.S. Pat. No. 7,601,473, the disclosure of which is incorporated herein in its entirety by reference. The surface treatment states of free, tacked, embedded, and engulfed are described in this patent and the impact of each state on the performance of the toner in an electrophotographic process is given. The use of two or more types of surface treatment particles with different degrees of tacking is described to obtain a balance between surface forces and charging properties of toner in an electrophotographic device.

Surface force modification by surface treatment occurs due to separation of the toner surface from other surfaces. This separation reduces the adhesive and cohesive forces on the toner and improves transfer of toner from the photoconductor to intermediate and final receivers. As the surface treatment is embedded, these forces increase, reducing powder flow and transfer performance of the toner.

When added to the toner with a relatively low energy and low temperature mixing process, surface treatment particles are weakly adhered to toner surfaces and are thus free to transfer to other surfaces, such as magnetic carrier particles in a two-component toner-carrier mixture, or to a photoreceptor or intermediate transfer member surface. In this state we define surface treatment particles as being free. When added to toner using a higher temperature and higher energy mixing process, surface treatment particles can become "tacked" to the toner surface and thus transfer less readily to other surfaces. In the tacked state surface treatment particles however still function to achieve separation of the toner surface from other surfaces such as the photoconductor or other toner particles, and thus are effective in improving performance in aspects like transfer efficiency and bulk toner powder flow. The use of even higher energy and higher temperature mixing processes will result in the surface treatment particles become physically embedded in the toner particles, a condition which results in the loss of separation of surfaces and a resulting loss of performance in properties like transfer efficiency and bulk powder flow. It is observed that the use of a two component toner-carrier developer mixture in a toning station results in embedment of surface treatment particles due to the energy of collisions between particles in mixing zones, transporting augers, and other energy imparting sections of the toning equipment. The result is the loss of performance due to the loss of the surface treatment separating function just described. Finally, by the application of even more energy surface treatment particles can become completely engulfed within the toner particles, as seen for example in an electron microscope. In this state the desirable properties of the surface treatment particles are lost completely. The progression of free to tacked to embedded to engulfed surface treatment states is a continuum; as well a given toner particle can have surface treatment particles present in all of these states simultaneously. In the present invention we define a degree of tacked state versus free state surface treatment by a quantitative measurement of the transfer of surface treatment agents from a toner surface to a clean carrier particle surface. It is an object of the present invention to provide surface treated toner with a high degree of tacked surface treatment such that the beneficial effects due to separation are realized, while minimizing the deleterious effects of large quantities of free surface treatment such as filming on the photoreceptor and transfer intermediate member surfaces.

The surface treatment particles are often treated with chemical modifiers to reduce their surface energy and improve their performance as powder flow aids. The impact of these modifiers on tacking and embedment are described in U.S. Pat. No. 7,601,473. The surface energy of powders may be characterized by a mid point and a range of surface energy between no wetting and complete wetting by mixtures of water and methanol. Table 1 below gives values for various types of commercially available silica useful as surface treatments.

Also described in U.S. Pat. No. 7,601,473 are various toner and surface treatment formulations, and processing equipment and conditions needed to obtain the desired tacking state of the surface treatment. Tacking the surface treatment in place once uniformly dispersed on the toner surface under controlled conditions with low shear allows the use of lower surface treatment concentrations. Tacking will also prevent transfer of the surface treatment to other surfaces. However, the tacking initiates the embedment process and reduces the number of impacts a toner particle may sustain before the surface treatment becomes ineffective at maintaining the desired separation from other surfaces.

The collision energy required to tack the surface treatment may be reduced by increasing the temperature of the fluidized bed. At elevated temperature, less kinetic energy from collisions is required to generate sufficient heat at the contact point with the surface treatment to exceed the toner resin Tg. U.S. Pat. No. 7,601,473 teaches processing toner in a fluidized bed of elevated temperature ranging from 15° C. less than the Tg to the Tg of the toner with two or more surface treatment components to obtain the desired combination of tacked silica for improved powder flow and transfer performance with improved tribocharging.

The average degree of embedment varies with the residence time of the toner in a process. The longer the toner is in a process, the more collisions it undergoes and the greater the embedment. The residence time varies in a toning station is inversely proportional to the image content of the documents being printed with that toner. As a result, the surface treatment will undergo embedment and engulfment at long residence times. Processes that aerate the toner are most often used to surface treat toners with small particles. These devices rely upon particle-to-particle and particle-to-mixing member collisions. The kinetic energy of such collisions is proportional to the mass of the toner particle, hence to the cube of the toner size.

Larger surface treatment particles may sustain many more impacts before embedment reduces their effectiveness. As the size of surface treatment particles increase, the area of contact increases and the energy of collisions must be increased to bring the localized temperature above the Tg required for increasing the degree of embedment. Consequently, larger surface treatment particles are more difficult to tack to the toner. There is greater leverage for impacts to dislodge a larger surface treatment particle and a larger contact area is needed between the surface treatment and toner for the Van der Waal's forces to provide tacking. A greater amount of toner material must be displaced by the surface treatment to provide the required contact area. The amount of non-tacked surface treatment is driven by the width of the surface treatment particle size distribution because the large particles within the surface treatment require higher temperatures to tack and embed.

The total surface treatment that may be applied is limited by the ability to tack the silica. As the total projected area of the surface treatment approaches the outer surface area of the resin core particles of the toner, there is less exposed toner on which to tack the surface treatment. A secondary effect is that the collision forces during mixing are distributed over more contact points and less toner material is displaced by a given surface treatment particle during the collision resulting in lower contact area. This distribution of collision forces is greater for surface treatments having a narrow size distribution. For broad or bimodal surface treatment size distribution, the collision forces are concentrated on the large surface treatment particles where more energy is needed to affect tacking. Larger surface treatment particles are also known to protect smaller surface treatment particles from embedment due to the separation effect.

For toners with surface treatment in the free state, the surface treatment may be transferred to the carrier in two component developers modifying the developer flow and toner concentration sensor performance. The free surface treatment may also transfer to other soft surfaces and accumulate in a film. When the soft surface is a photoconductor, this film may lead to variations in imaging performance.

U.S. Pat. No. 5,066,558 teaches the use of a three-step process first to disperse a silica powder on a resinous core toner particle in a lower energy device, second to embed the silica in a second higher energy device such that there are little or no visible silica particles on the surface by SEM, and third to disperse additional silica powder in a device similar energy to that used in the first step. The method pertains to single component developers of 100 wt % toners and as such does not address issues of toner concentration control.

U.S. Pat. No. 6,087,057 teaches the use of two treated silica powders where the first silica powder is treated with an alkyl silane and an amino alkyl silane to give a negative charge and the second silica powder is treated with an organopolysiloxane that charges positive relative to the first and an third metal oxide to adjust charge. These formulas are selected solely for tribocharge stability upon admix, changes in relative humidity (RH), etc.

U.S. Pat. No. 6,582,866 teaches toner and processes for making toner where the toner comprises surface additive particles adhered to combined colorant and resin particles in a quantity greater than three percent of the combined weight of resin and colorant in the toner, where the surface treated toner is obtained by an impaction process employing a high intensity blending tool.

SUMMARY OF THE INVENTION

It is an object of the present invention is to provide surface treated toners that resist embedment of the surface treatment while maintaining low photoconductor filming properties and good powder flow.

It is an object of the invention to provide toners with rapid mixing and charging resulting in developers that have low dust and provide uniform images resulting in reduced maintenance and service costs.

It is another object to provide toners that resist transfer of components from the toner to the carrier surface in a two-component developer thereby providing long developer life, developer flow stability, and stable toner concentration control.

It is another object to provide toners that resist changes in the degree of surface treatment embedment with changes in residence time caused by changes in image content of print jobs.

Various ones of these and other objects described below may be obtained in accordance with the various embodiments of the invention described herein.

In one embodiment, the invention relates to a toner composition comprising: resin core particles having outer surfaces, and surface treatment, wherein the surface treatment comprises at least first metal oxide particles having a surface area equivalent average particle diameter of greater than 25 nm (preferably from 30 to 100 nm, more preferably from 35 to 75 nm) and a surface energy of less than 28 erg/cm$^2$, as determined by the methanol wettability midpoint at 22° C., tacked to the outer surfaces of the resin core particles, at a concentration to provide a total projected area of the first metal oxide particles sufficient to cover at least 10% (preferably 10 to 65%, more preferably 15 to 50%, and most preferably 15 to 40%) of the resin core particle outer surfaces area, and wherein the toner composition comprises less than 0.013 g (preferably less than 0.010 g, and more preferably less than 0.008 g) non-tacked surface treatment per square meter of resin core particles outer surface.

In another embodiment, the invention further relates to a developer for developing electrostatic images, comprising magnetic carrier particles and toner, where the toner comprises resin core particles having outer surfaces and surface treatment, wherein the surface treatment comprises at least first metal oxide particles having a surface area equivalent average particle diameter of greater than 25 nm (preferably from 30 to 100 nm, more preferably from 35 to 75 nm) and a surface energy of less than 28 erg/cm$^2$, as determined by methanol wettability midpoint at 22° C., tacked to the outer surfaces of the resin core particles, at a concentration to provide a total projected area of the first metal oxide particles sufficient to cover at least 10% (preferably 10 to 65%, more preferably 15 to 50%, and most preferably 15 to 40%) of the resin core particle outer surfaces area, and wherein the developer comprises less than 0.013 g (preferably less than 0.010 g, and more preferably less than 0.008 g) non-tacked surface treatment per square meter of resin core particles outer surface, that is free to transfer between the outer surface of the resin core particles and outer surfaces of the magnetic carrier particles.

DETAILED DESCRIPTION OF THE INVENTION

Toners used in color electrographic printers are typically polymeric particles of approximately 4 to 10 microns, and more typically 5 to 8 microns volume average particle size, containing dispersed colorants, charge control agents, waxes, and other addenda.

Preferably, the toner includes a binder, and optionally includes a colorant, a charge control agent, and an anti-blocking agent, which can be blended to form toner particles. Binders can be selected from a wide variety of materials, including condensation polymers such as polyesters as well as both natural and synthetic resins and modified natural resins, as disclosed, for example, in U.S. Pat. No. 4,076,857. Other useful binders can include the crosslinked polymers as disclosed in U.S. Pat. Nos. 3,938,992 and 3,941,898. The crosslinked or noncrosslinked copolymers of styrene or lower alkyl styrenes with acrylic monomers such as alkyl acrylates or methacrylates may also be used. Numerous polymers suitable for use as toner resins are disclosed in U.S. Pat. No. 4,833,060. Consequently, the teachings of U.S. Pat. Nos. 3,938,992; 3,941,898; 4,076,857; and 4,833,060 are hereby incorporated by reference in their entirety. In addition, another desired binder is a bisphenol based polyester of the acid value between 1 and 40. The toner typically comprises 85 to 95 weight percent by weight of the binder. Such a binder can be propoxylated bisphenol-A combined with fumaric or terephthalic acid.

Optionally, the binder can be compounded with a colorant, i.e., a dye or pigment, either in the form of a pigment flush (a special mixture of pigment press cake and resin well-known to the art) or pigment-resin masterbatch, as well as any other desired addenda known to the art. If a developed image of low opacity is desired, no colorant need be added. Normally, however, a colorant can be included and it can, in principle, be any of the materials mentioned in *Colour Index*, Vols. I and II, 2nd Edition (1987) or Herbst and Hunger, *Industrial Organic Pigments,* $4^{th}$ edition (2004). Carbon black can be especially useful while other colorants can include pigment blue, pigment red, and pigment yellow. Specific colorants can include copper phthalocyanine having a CI colour index P.B.15:3, metal-free phthalocyanine P.B.16, chlorinated and bromated copper phthalocyanines such as P.G. 7 and P.G. 36, triarylcarbonium blue pigments such as P.B.61, dioxazine violet pigments such as P.V.23 calcium, laked monoazo BONA class pigments such as P.R. 57:1,2,9-dimethylquinacridone P.R.122, Napthol red pigments such as P.R. 146, β-Napthol red and orange pigments such as P.R. 53:1 and P.O. 5, Benzimidazolone pigments such as P.R. 180, diazo pigments such as P.Y.12, P.Y 13, P.Y. 83, and P.Y. 93, and isoindoline pigments such as P.Y. 139 and P.Y. 185. The amount of colorant, if used, can vary over a wide range, e.g., from about 1 to about 25, and preferably from about 3 to about 20 weight percent of the toner component. Combinations of colorants may be used as well.

The toner can also contain charge control agents. The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; 4,394,430; and British Patents 1,501,065 and 1,420,839, the teachings of which are incorporated herein by reference in their entirety. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts. A particular example of an iron organo metal complex is T77 from Hodogaya.

Furthermore, quaternary ammonium salt charge agents as disclosed in Research Disclosure, No. 21030, Volume 210, October 1981 (published by Industrial Opportunities Ltd., Homewell, Havant, Hampshire, PO9 1EF, United Kingdom) may also be used. Specific charge control agents can include aluminum and/or zinc salts of di-t-butylsalicylic acid. Additional examples of suitable charge control agents include, but are not limited to, acidic organic charge control agents. Particular examples include, but are not limited to, 2,4-dihydro-5-methyl-2-phenyl-3H-pyrazol-3-one (MPP) and derivatives of butylsalicylic MPP such as 2,4-dihydro-5-methyl-2-(2,4,6-trichlorophenyl)-3H-pyrazol-3-one, 2,4-dihydro-5-methyl-2-(2,3,4,5,6-pentafluorophenyl)-3H-pyrazol-3-one, 2,4-dihydro-5-methyl-2-(2-trifluoromethylphenyl)-3H-pyrazol-3-one and the corresponding zinc salts derived there from. Other examples include charge control agents with one or more acidic functional groups, such as fumaric acid, malic acid, adipic acid, terephthalic acid, salicylic acid, fumaric acid monoethyl ester, copolymers of styrene/methacrylic acid, copolymers of styrene and lithium salt of methacrylic acid, 5,5'-methylenedisalicylic acid, 3,5-di-t-butylbenzoic acid, 3,5-di-t-butyl-4-hydroxybenzoic acid, 5-t-octylsalicylic acid, 7-t-butyl-3-hydroxy-2-napthoic acid, and combinations thereof. Still other acidic charge control agents which are considered to fall within the scope of the invention include N-acylsulfonamides, such as, N-(3,5-di-t-butyl-4-hydroxybenzoyl)-4-chlorobenzenesulfonamide and 1,2-benzisothiazol-3(2H)-one 1,1-dioxide.

Preferably, the charge control agent is, if used, provided in an amount of about 0.2 to about 5 weight percent of the total toner weight and preferably in an amount of about 1 to about 3 weight percent of total toner weight.

The toner can optionally contain other additives, such as anti-blocking agents or waxes, such as polypropylene, polyethylene, or copolymers and blends thereof.

The terms "surface treatment" or "external additive" are typically used to describe such a toner formulation ingredient that is a fine particulate which is added after the core toner particle has been prepared. The most commonly used surface treatment agent on toner is fumed silica, especially hydrophobic silica. Fumed silica is available in a range of primary particle sizes, which is typically measured rather as the specific surface area by the BET nitrogen adsorption method. Since the ratio of volume of a sphere having a diameter D to surface area of the sphere is 6/D, the surface area equivalent particle diameter is six divided by the product of the specific surface area and the density of the particle. In general, manufacturers of materials such as silica, titania or alumina specify the specific surface area of a grade, rather than its particle size. The BET surface area measurement is made on the material before it is post treated, as the hydrophobic coatings employed have an effect on the nitrogen absorption coefficient. For the purposes of the present discussion, references to the particle size of such materials are as the surface area equivalent average particle diameters calculated as above. The smallest commercially available fumed silica materials have a BET surface area of about 400 $m^2/g$ corresponding to silica particle surface area equivalent diameter of about 7 nm in size, while commercially available materials having a BET surface area of about 50 $m^2/g$ correspond to silica particles having a surface area equivalent average particle diameter of about 55 nm in size. As a general rule, the smaller the primary particle size of the silica (and inversely the higher the BET specific surface area), the more free-flowing will be the resulting surface treated toner for a given weight percent of silica added. We have found that fumed silica materials at about 50 $m^2/g$ BET surface area corresponding to silica particle of about 55 nm diameter in size have a reduced effectiveness as a flow aid for toner and this size defines a preferred upper limit of functioning as a flow aid surface treatment. The smallest fumed silica materials become more difficult to disperse and provide very high charge levels. Surface treatment levels that give good charging characteristics often fail to provide good flow properties.

Another method of manufacturing oxide powders useful as surface treatments for toner is controlled chemical precipitation. Under conditions promoting rapid nucleation, high surface area aggregated powders of titania and alumina can be produced that are useful for surface treatment to modify charging and powder flow properties. Colloidal silica materials of lower surface area are formed by slow nucleation and controlled growth in aqueous media. These colloidal materials are uniformly spherical in shape and may have no hard aggregates such as those produced in high temperature processes like that used in the manufacture of fumed silica. Colloidal silica materials are available from Wacker as HDK HKS C, from Cabot as the TG-C product line, and Sukgyung AT Co., Ltd. of South Korea as the SG-SO product line.

A third method of manufacturing submicron particles useful as surface treatments is to disperse submicron ground particles in intense heat to melt and make spherical the oxide powder. An example is the fused silica UFP-40HH from Denka Kagaku Kogyo Co., Ltd. of Japan.

The use of titania to modify charging properties of toners is described, e.g., in U.S. Pat. No. 6,358,686. Titania are available as precipitated milled natural titania such as JMT-IB from Tayca, fumed titania T805 and NKT90 from Evonik (formerly Degussa) and colloidal titania from Sukgyung as the SG-TO product line. Also useful in adjusting charging properties are co-fumed silica-titania surface treatments such as STX-501 and STX-801 from Evonik. Fumed alumina may also be used to adjust powder flow and charging properties. Examples of fumed alumina are C805 from Evonik and the SpectrAl product line from Cabot.

An organic coating is typically applied to the fumed silica in order to cover surface silanol groups in order to render the silica hydrophobic. Common coatings include silicone fluid also known as polydimethylsiloxane (PDMS), hexamethyldisilazane (HMDS), and dimethyldichlorosilane (DMDCS), Dimethyldiethoxysilane (DMDES), Decyltrimethoxysilane (DTMS) and other alkyl silanes. Such materials are available commercially from vendors including Evonik, Cabot and Wacker.

The propensity of a surface treatment to tack is related to the difference in surface energy between that of the surface treatment and that of the toner. Surface treatments with surface energies lower than that of the toner will tack and embed more slowly. A typical polymer used for toner will have a surface energy between 40 and 55 $ergs/cm^2$ while that of the surface treatment can vary from less than 30 to greater than 60 $ergs/cm^2$. The surface treatment may become engulfed in the polymer when its surface energy is greater than that of the toner polymer. The surface energy of surface treatments can be assessed by the concentration of methanol in water at which the dry powder will wet, a standard technique known as the methanol wettability test. Table 1 shows the results of such a test for varying surface treatments, with both mid point and range of surface energy between no wetting and complete wetting by mixtures of water and methanol reported. Surface energies in Table 1 were interpolated for 22° C. from Vazques, Alverez, and Navaza, *J. of Chem. Eng. Data,* 1995, Vol. 40 pp 611-614.

TABLE 1

Methanol Wettability of Various Surface Treatments at 22° C.

| Product (Manufacturer) | Uncoated SSA $m^2/g$ | Average Size nm | Coating | Surface Energy γ $erg/cm^2$ Mid-point | Range |
|---|---|---|---|---|---|
| RY50 (Evonik) | 50 | 55 | PDMS | 25.0 | 1.6 |
| NY50L2 (Evonik) | 50 | 55 | PDMS | 25.9 | 3.5 |
| VPNY90G (Evonik) | 90 | 30 | PDMS | 27.9 | 4.3 |
| RY200 (Evonik) | 200 | 14 | PDMS | 27.9 | 4.3 |
| UFP-40HH (Denki Kagaku Kogyo) | 35 | 78 | PDMS | 28.7 | 9.0 |
| NAX50L (Evonik) | 50 | 55 | HMDS | 28.9 | 2.4 |
| NX90G (Evonik) | 90 | 30 | HMDS | 28.9 | 2.4 |
| RX200 (Evonik) | 200 | 14 | HMDS | 28.9 | 2.4 |
| MSN-005 (Tayca) | 25 | 109 | PDMS | 29.5 | 7.4 |
| SG-SO100CDM8 (Sukgyung) | 35 | 78 | DMDES | 30.4 | 5.4 |
| RX50 (Evonik) | 50 | 55 | HMDS | 30.4 | 5.4 |
| HDK H05TM (Wacker) | 50 | 55 | HMDS | 30.4 | 5.4 |
| HDK H05TX (Wacker) | 50 | 55 | PDMS/ HMDS | 30.4 | 5.4 |
| RY200S (Evonik) | 130 | 21 | PDMS | 30.4 | 5.4 |
| RX300 (Evonik) | 300 | 9 | HMDS | 30.4 | 5.4 |
| HDK H05TD (Wacker) | 50 | 55 | PDMS | 31.6 | 3.0 |
| R972 (Evonik) | 130 | 21 | DCDMS | 31.6 | 3.0 |
| SG-SO100CDT8 (Sukgyung) | 35 | 78 | DTMS | 32.3 | 9.1 |
| TG-810G (Cabot) | 325 | 8 | HMDS | 33.4 | 6.7 |
| SG-TO 50CDT8 (Sukgyung) | 25 | 59 | DTMS | 37.6 | 19.9 |
| SG-SO 50CDP8 (Sukgyung) | 25 | 109 | PDMS | 38.8 | 17.5 |
| SG-SO 50CDP5 (Sukgyung) | 25 | 109 | PDMS | 38.8 | 17.5 |
| SG-SO 100CDP5 (Sukgyung) | 18 | 152 | PDMS | 43.3 | 26.5 |
| TG-C413 (Cabot) | 50 | 55 | HMDS | 57.1 | 47.9 |
| SG-SO 30CDP5 (Sukgyung) | 90 | 30 | PDMS | 58.9 | 44.2 |

A quantitative measure of the degree of tacking can be obtained by transfer of the free surface treatment to the surface of a probe that is similar in nature to the core toner provided some method of separating the probe from the core is available. The free surface treatment will distribute uniformly over both the toner and probe surfaces while the tacked surface treatment will stay with the toner. The degree of tacking can be calculated from a bulk analysis such as x-ray fluorescence (XRF), neutron activation, or ICP for the surface treatment on the probe surface or toner before and on both the toner and the probe after mixing and separation. An effective probe surface is the carrier from two component developers in which the toner has been electrostatically stripped in a toning-like process. The amount of transferred surface treatment and therefore the amount of free surface treatment can be calculated based upon the surface area of the toner and probe used in the mixing step. For probe surfaces of equal hardness and surface energy as the toner, the free surface treatment will distribute equally over the open surface not covered by tacked and embedded surface treatment. Thus the weight concentration of surface treatment on the probe can be used to calculate surface concentration of treatment on the probe and, by knowing the ratio of probe to toner surface areas, the surface concentration of free surface treatment remaining on the toner. A simple mass balance is then used to calculate the initial free surface treatment on the toner. Further methods of evaluating the degree of tacking using probe surfaces are described in U.S. Pat. No. 7,601,473.

Properties of the probe surface can be chosen to select the more easily transferred surface treatment particles. Very little transfer of free surface treatment to hard inorganic surfaces is found for probe materials such as uncoated ferrite used in carrier of a dual component developer. A thin polymer coating on this ferrite will select the more easily transferred surface treatments. This can be further tailored by the surface energy of the polymer with less transfer to lower surface energy coatings.

In accordance with the present invention, resin core particles having outer surfaces are combined with surface treatment comprising at least first metal oxide particles having a surface area equivalent average particle diameter of greater than 25 nm (preferably from 30 to 100 nm, more preferably from 35 to 75 nm) and a surface energy of less than or equal to 28 erg/cm$^2$, as determined by methanol wettability midpoint at 22° C. The surface treatment is tacked to the outer surfaces of the resin core particles at a concentration to provide a total projected area of the first metal oxide particles sufficient to cover at least 10% (preferably 10 to 65%, more preferably 15 to 50%, and most preferably 15 to 40%) of the resin core particle outer surfaces area, under conditions such that the resulting toner composition comprises less than 0.013 g (preferably less than 0.010 g, and more preferably less than 0.008 g) non-tacked surface treatment per square meter of resin core particles outer surface. Toner meeting such combined requirements of surface treatment particle size, minimum coverage, maximum surface energy, and maximum amount of free (non-tacked) surface treatment has been found to provide desired combination of good transfer performance and long photoconductor life when employed in electrophotographic processes. Further optimization of surface treatment coverage within preferred ranges has been found to maintain desired transfer and photoconductor life while also enabling low fuser contamination in electrophotographic processes.

Surface treatment particles having surface energy of less than or equal to 28 erg/cm$^2$ for use in the present invention preferably comprise silica covered with an organic coating which renders the silica hydrophobic. Most preferred is fumed silica covered with polydimethylsiloxane (PDMS). Examples of relatively large size surface treatment materials having the required surface energy include RY50, NY50L2 and VPNY90G, all available from Evonik, as reported in Table 1 above.

In further specific embodiments of the invention, the toners are combined with a carrier to form a developer. More specifically, a developer in accordance with such embodiments for developing electrostatic images comprises: magnetic carrier particles, and toner comprising resin core particles having outer surfaces and surface treatment comprising at least first metal oxide particles having a surface area equivalent average particle diameter of greater than 25 nm (preferably from 30 to 100 nm, more preferably from 35 to 75 nm) and a surface energy of less than or equal to 28 erg/cm$^2$, as determined by methanol wettability midpoint at 22° C., tacked to the outer surfaces of the resin core particles, at a concentration to provide a total projected area of the first metal oxide particles sufficient to cover at least 10% (preferably 10 to 65%, more preferably 15 to 50%, and most preferably 15 to 40%) of the resin core particle outer surfaces area, and wherein the developer comprises less than 0.013 g (preferably less than 0.010 g, and more preferably less than 0.008 g) non-tacked surface treatment per square meter of resin core particles outer surface, that is free to transfer between the outer surface of the resin core particles and outer surfaces of the magnetic carrier particles. The magnetic carrier particles preferably make up 60 to 99 weight percent of the developer; and the toner preferably makes up 1 to 40 weight percent, more preferably about 2 to about 20 percent and even more preferably between 5 and 12 weight percent of the developer.

Preferably, the average particle size ratio of carrier to toner particles is from about 15:1 to about 1:1. However, carrier-to-toner average particle size ratios of as high as about 50:1 can be useful. Preferably, the volume average particle size of the carrier particles can range from about 5 to about 50 microns. U.S. Pat. Nos. 4,546,060 and 4,473,029, the disclosures of which are incorporated herein by reference, describe that the use of "hard" magnetic materials as carrier particles increases the speed of development dramatically when compared with carrier particles made of "soft" magnetic particles. The preferred ferrite materials disclosed in these patents include barium, strontium and lead ferrites having the formula $MO_6Fe_2O_3$ wherein M is barium, strontium or lead. However, magnetic carriers useful in the invention can include soft ferrites, hard ferrites, magnetites, sponge iron, etc. In addition, the magnetic carrier ferrite particles can be coated with a polymer such as mixtures of polyvinylidenefluoride and polymethylmethacrylate or silicone resin type materials.

The adhesive forces of the toner may be evaluated by many methods. A common method is to measure aerated bulk density (ABD). A lower ABD is indicative of greater cohesion. This method was found to be sensitive to sample presentation, relative humidity, toner shape, and toner size. Another method is to measure the sieving rate and sieve retention. The sample presentation is controlled by level placement of the toner in a four inch ring on the center of an eight inch 270 U.S. standard mesh sieve. After the ring is removed, the sieve is shaken in a circular motion about a horizontal axis with a sieve shaker (Tyler Model RX-24) for a short time and the weight of toner passing the sieve recorded. This is repeated with time intervals that generate a logarithmic scale. The data are fit with an exponential function taking into account a retention of toner that will not pass through the sieve. The time constant of the exponential fit is used to evaluate powder flow while 10% or higher toner retention indicates transition to embedment.

The concentration of surface treatment is limited by the ability to tack the surface treatment when it is desired to keep the level of free silica low enough to avoid problems such as photoconductor filming. While high levels of free silica can be reduced by processing at increased temperatures, the processing latitude becomes unacceptably small when the projected area of the surface treatment is greater than about 65% of that of the toner. Surface treatment area coverage of the toner is calculated from the projected area of the surface treatment agent taken from its BET surface area, toner surface area via BET and the weight % of the surface treatment particles corrected for the weight % of surface coating such as PDMS.

In addition to limiting the ability to tack surface treatment, high concentrations of surface treatments lead to increased fuser contamination for rough, thin papers using mild fusing conditions to achieve low gloss. Under such conditions, the flow deformation by melting may increase the contact area of individual toner particles on the fuser roller without substantially changing the contact area with paper fibers. Surface treatment between the toner polymer and the paper fiber reduces the adhesive force to the paper and, due to the larger contact area fuser roller, some toners transfer to the fuser roller even in the presence of low surface energy fuser oil.

The degree of tacking, embedment, and engulfment may be evaluated as a function of temperature for given surface treatment using a combination of silica transfer to a probe surface and sieve rate. Table 2 shows the impact of toner Tg on the surface treatment state for toners of propoxylated bisphenol-A combined with fumaric or terephthalic acid ground to 1.3 $m^2/g$ and surface treated with NY50L2, a milled 50 $m^2/g$ PDMS treated silica from Evonik. Core toner particles of 6 μm diameter and surface treatment agents were mixed in a 10 L Henschel blender equipped as described in Example 3; samples were removed at the indicated temperatures as the contents of the mixer increased in temperature over time. It is seen that as temperature increases, the toner bulk powder flow ability is decreased as evidenced by an increase in sieving time constant, while the amount of free silica is decreased. Below toner surface area coverage by surface treatment of about 40%, the same fraction of silica is tacked and embedded for the two toners of different Tg when comparing at the same offset from the individual toner Tg's.

TABLE 2

Impact of Temperature and Tg on Tacking and Powder Flow

| | Toner Resin Tg 54° C. | | | | | | | Toner Resin Tg 59° C. | | |
|---|---|---|---|---|---|---|---|---|---|---|
| | 2% NY50L2 19.3% Area Coverage | | | 4% NY50L2 38.5% Area Coverage | | | | 4% NY50L2 38.5% Area Coverage | | |
| Temp | Sieve rate | | Free Silica | Sieve rate | | Free Silica | Temp | Sieve rate | | Free Silica |
| ° C. | τ s | Ret. | $m^2/g$ | τ s | Ret. | $m^2/g$ | ° C. | τ s | Ret. | $m^2/g$ |
| 50 | 21 | 2% | | 20 | 2% | | | | | |
| 53 | 23 | 1% | 0.0127 | 18 | 4% | | | | | |
| 56 | 28 | 4% | 0.0089 | 18 | 5% | 0.0189 | 55 | 26 | 5% | 0.0266 |
| 59 | 51 | 9% | 0.0054 | 26 | 5% | 0.0099 | 58 | 20 | 3% | 0.0227 |
| 62 | 70 | 52% | | 42 | 15% | 0.0041 | 61 | 21 | 4% | 0.0163 |
| 65 | 309 | 33% | | 175 | 41% | | 64 | 24 | 6% | 0.0131 |
| | | | | | | | 67 | 87 | 18% | 0.0045 |

Toner compositions in accordance with the present invention may be obtained by adhering surface treatment of the specified compositions to toner resin core particles under mixing conditions of controlled temperatures and mixing intensity sufficient to achieve the desired surface treatment coverage and level of free surface treatment. In one embodiment, toner compositions in accordance with the present invention may be obtained by a process for adhering surface treatment to toner resin core particles comprising: providing resin core particles comprising a binder polymer having a Tg and having outer surfaces; providing surface treatment comprising at least first metal oxide particles having an average particle size of greater than 25 nm (preferably from 30 to 100 nm, more preferably from 35 to 75 nm) and a surface energy of less than or equal to 28 $erg/cm^2$, as determined by methanol wettability midpoint at 22° C., and tacking the at least first metal oxide particles to the resin core particles by mixing at a temperature greater than the Tg of the binder polymer, preferably at a temperature of from about 4 to 20 C greater than the Tg of the binder polymer, more preferably at a temperature of from about 6 to 15 C greater than the Tg of the binder polymer, and more preferably at a temperature of from about 8 to 15 C greater than the Tg of the binder polymer. While lower temperatures may be employed in other embodiments when employing higher mixing intensity, use of temperatures greater than the Tg of the binder polymers is preferred for tacking the specified surface treatments to obtain toners in accordance with the present invention, as the combination of such higher temperature mixing has surprisingly been found to result in the desired combination of toner performance properties demonstrated in the present invention when employing relatively large size, low surface energy surface treatment particles.

In accordance with a specific embodiment of the invention, the surface treatment employed may further comprises second metal oxide particles having a surface area equivalent average particle diameter of less than 25 nm in addition to the first metal oxide particles having a surface area equivalent average particle diameter of greater than 25 nm and surface energy of less than or equal to 28 $erg/cm^2$. In such embodiment, the second metal oxide particles further may have a surface energy midpoint of greater than 28 $erg/cm^2$, as determined by methanol wettability at 22° C. A low level of smaller surface treatment aids in powder flow and transfer under stress conditions of low takeout jobs if sufficient large surface treatment is present. Lower levels of large surface treatment are also sufficient if tacked into place.

The examples will illustrate a number of embodiments of inventive toners with improved performance characteristics. The use of larger surface treatments is seen to improve transfer efficiency, but at the expense of undesirable properties such as filming on the photoreceptor due to the large amount of free surface treatment silica. It is seen that the inventive high temperature processing conditions yield toners with reduced free surface treatment levels, thus resulting in improved life of the photoreceptor, while still maintaining or even enhancing the improved transfer performance. It will be seen that the lower the surface energy of the larger surface treatment, the better the transfer efficiency. It will however be seen that the use of low surface energy small surface treatment particles is not sufficient to yield improved transfer performance, rather low surface energy large surface treatment agents are required. Smaller surface treatment agents are known to promote better powder properties than large surface treatment agents. Specific embodiments show that the use of a combination of small silica and low surface energy large silica along with the high temperature processing conditions yields toner which exhibits good bulk powder flow, improved transfer, low free silica, and low fuser contamination. Tri-component surface treatment blends comprising small silica and low surface energy intermediate and large sized silica result in further improved powder flow while maintaining good transfer and low free silica.

Surface treatment materials are known to become embedded in the toner surface due to the input of collision energy in a toning station using two-component developer materials. Low throughput conditions of low image content result in greater embedment of surface treatment agents relative to high throughput high image content jobs, with the result being a loss of transfer performance at the low throughput high embedment condition. The inventive use of low surface energy large surface treatment particles in a high temperature process that leads to low free silica will be seen to reduce the sensitivity of toner to job stream related stress.

Mixing intensity is reduced by going to smaller toners, and processing temperatures may be increased to achieve the same level of free surface treatment. The pigment percentage is typically increased and the amount of toner used per image is typically less for smaller toner. Generally, the pigment level is scaled such that a constant specific surface area of toner is used per print area to obtain the same print density. It will be demonstrated that the use of higher temperatures can be used to compensate for the loss of mixing intensity when employing smaller toners to achieve similar levels of free surface treatment.

In a further embodiment of the invention, improved powder flow of smaller surface treatments with improved transfer performance of large surface treatments may be obtained with the further use of an intermediate sized surface treatment in combination with larger and smaller sized surface treatments. Increased toner surface coverage is needed to maintain good transfer performance and improved powder flow at the expense of fuser contamination.

Surprisingly, rapid charging is achieved at lower levels of free silica when larger silica is used as at least one of the surface treatment components. As a result, low filming toners with good charging and transfer properties may be obtained.

The following examples illustrate the practice of this invention. They are not intended to be exhaustive of all possible variations of the invention. Parts and percentages are by weight unless otherwise indicated.

EXAMPLES

Example 1

Example 1 consists of a composite average performance of toners made using a polyester resin having a Tg of 54° C., with various pigments including carbon black, PY 185 masterbatch in polyester, or PB 15:3, PY 122 and PR 185 flushed in polyester, and a charge control agent of di-t-butylsalicylic acid zinc salt. The toners were ground to volume median diameter of 8 microns in a Hosakawa-Alpine 530AFG pulverizer and had a specific surface are of 1.05 $m^2/g$ as measured by Kr BET using a Micromeritics Tristar II 3020. The toner was surface treated with 1.5% of NY50L2, a milled 50 $m^2/g$ PDMS treated silica from Evonik, and 0.75% of R972, a 130 $m^2/g$ DCDMS treated silica from Evonik, in 70 Kg batches using a 350 L Henschel mixer at 960 RPM with a scraper blade, two aeration blades, and a horn tool taking about 10 minutes to achieve temperature and held for 10 minutes at the target temperature of 66° C. Transfer residuals were measured by transmission density measurements on tapes recovering the residual from the photoconductors and intermediate transfer member or blanket cylinder and on oven fused prints made on a NexPress 2500 with an aged blanket cylinders having poor transfer performance. Running documents were selected to stress the surface treatment embedment state. A high toner throughput condition of 700 tabloid prints of an image containing 56% coverage for each color separation was used to achieve a low embedment state for small silica, and 100 minutes of a low throughput image with 0.7% image coverage was used to achieve a high embedment state for small silica. Toners in Comparative Example 1A have only R972 small silica. They are surface treated with 1.25% for toners with PY 185 or 1.5% R972 for other colors; they are processed at 22° C. for 8 minutes for toners with BP 15:3 or processed about 5 minutes to achieve 52° C. and held while mixing at that temperature for 10 minutes for other colors. Toners in Example 1B were processed like those of Example 1 but with 2.25% NY50L2 and 0.5% R972, while toner in Comparative Example 1C was made similarly to Example 1B, but processed at 52° C. Free silica was evaluated using a polymethylmethacrylate (PMMA) coated strontium ferrite that was mixed with the toner, then electrostatically stripped and measured for silica using inductively coupled plasma atomic emission spectroscopy (ICP). The transfer performance was evaluated in a NexPress 2500 under stress conditions leading to poor transfer for both low (1,400 A4 prints of 56% image content) and high (8,000 A4 prints at 0.7% image) degree of surface treatment embedment.

TABLE 3

Example 1 Data

| | | Formulation | | | Imaging Process | | |
|---|---|---|---|---|---|---|---|
| | | | | Free | Residual Toner | | |
| | Process temp | Total Silica | Large Silica | Silica $g/m^2$ | 56% Image | 0.7% Image | Relative PC Life |
| Example 1 Area Cov. 39.3% | 66° C. | 2.25% | 1.50% | 0.0036 | 3.9% | 6.8% | 97% |
| Comparative Example 1A Area Cov. 46.0% | 52° C. | 1.50% | 0.0% | 0.0024 | 9.1% | 15.2% | 100% |
| Example 1B Area Cov. 40.1% | 66° C. | 2.75% | 2.25% | 0.0053 | 2.4% | 4.9% | 85% |

TABLE 3-continued

| Example 1 Data | | | | | | | |
|---|---|---|---|---|---|---|---|
| | | Formulation | | | Imaging Process | | |
| | | | | Free | Residual Toner | | |
| | Process temp | Total Silica | Large Silica | Silica g/m$^2$ | 56% Image | 0.7% Image | Relative PC Life |
| Comparative Example 1C Area Cov. 40.1% | 52° C. | 2.75% | 2.25% | 0.0148 | 3.9% | 6.4% | 62% |

Comparative Example 1A, the surface treatment of which comprises only small silica, is seen to have inferior transfer performance relative to Examples 1 and 1B and Comparative Examples 1C which all have large silica and small silica. However, the amount of free silica on comparative example 1A is low, so the result is good filming performance; 100% of the photoreceptor life is achieved. By use of elevated temperature surface treatment tacking conditions, the inventive toners of Example 1 are seen to exhibit excellent transfer in that transfer residuals are low, while the low amount of free silica results in nearly identical filming performance to Comparative Example 1. Example 1 is illustrative of using a relatively low level of large silica to achieve a good level of transfer. Example 1B and Comparative Example 1C further illustrate this point, in that they are of the same surface treatment composition, but the higher processing temperature of Example 1B results in less free silica and thus less filming on the photoreceptor. In addition, the transfer efficiency of Example 1B is higher than Comparative Example 1C. The processing temperature is about 12 C higher in temperature than the toner resin Tg of 54 C; that the toner can survive such conditions without aggregating was unexpected, and is believed to be due to the protective spacing effect of the silica materials preventing core toner to core toner contact.

Example 2

Example 2 toner of similar composition and size as Example 1 was made from 14.6 kg of a yellow core toner, 338 g of NY50L2 (2.25%), and 75 g of R972 (0.5%). The toner was surface treated in a 75 L Henschel mixer having a scraper blade and a ring tool using two processing steps. The toner and NY50L2 were mixed for 19 minutes at 1745 RPM with active heating to obtain a temperature of 68° C. in about 4 minutes and intermittent cooling thereafter to maintain a constant temperature for 15 minutes. Example 2A was made in the same manner as Example 2 except the batch was held at 66° C. Comparative Example 2B toner was made in the same manner as Example 2 toner except 0.7% R972 was used and the batch was processed at a temperature of 52° C. for 4 minutes. Example 2C toner was processed similar to Example 2 toner except the batch was processed at an intermediate temperature of 60° C. Comparative Example 2D was formulated with 3% NAX50, a 50 m$^2$/g silica treated with HMDS from Evonik, and 0.35% R972 and processed at 60° C. similar to Example 2C. Free silica and transfer performance was evaluated in the same manner as Example 1.

TABLE 4

| Example 2 Data | | | | | | | |
|---|---|---|---|---|---|---|---|
| | | Formulation | | | | Imaging Process Residual Toner | |
| | Process temp | Total Silica | Large Silica | Free g/m2 | Large Coat | 56% Image | 0.7% Image |
| Example 2 Area Cov. 40.1% | 68° C. | 2.75% | 2.25% | 0.0051 | PDMS | 4.3% | 5.0% |
| Example 2A Area Cov. 40.1% | 66° C. | 2.75% | 2.25% | 0.0076 | PDMS | 5.2% | 6.0% |
| Comparative Example 2B Area Cov. 46.1% | 52° C. | 2.95% | 2.25% | 0.0151 | PDMS | NA | |
| Example 2C Area Cov. 40.1% | 60° C. | 2.75% | 2.25% | 0.0103 | PDMS | 3.1% | 7.1% |
| Comparative Example 2D Area Cov. 46.5% | 60° C. | 3.35% | 3.00% | 0.0112 | HMDS | 5.8% | 13.4% |

Examples 2, 2A and 2C demonstrate that good transfer performance and low free silica may be obtained for higher PDMS treated large silica formulas by using high processing temperatures to effectively tack the surface treatment and provide low free silica levels for reducing photoconductor filming properties. The surface coverage of the toner by silica is about 45% and is near the limit of acceptable fuser contamination for some paper types. Comparative Example 2D in combination with Examples 2, 2A and 2C demonstrates that PDMS treated low surface energy large silica is much more effective in improving transfer than the higher surface energy HMDS treated large silica.

Example 3

Example 3 toner of similar composition and size as Example 1 was made from 1.945 kg of a cyan core toner, 45 g of NY50L2 (2.25%), and 10 g of R972 (0.5%). The toner was surface treated in a 10 L Henschel mixer having a scraper blade, an aeration blade, and a horn tool. The silica surface treatments and toner were mixed for a total of 7.5 minutes at 3000 RPM with active heating to obtain a temperature of 52° C. in about 4 minutes and intermittent cooling thereafter to maintain a constant temperature. Comparative Example 3A was made in the same manner as Example 3 except RX50, a 50 $m^2/g$ HMDS treated silica from Evonik, was used instead of the PDMS treated NY50L2. Comparative Example 3B was made in the same manner as Example 3 except Aerosil 50, the untreated silica used to make NY50L2, was used instead of PDMS treated NY50L2. The area coverage of the surface treatment is about 40% for all of these examples.

TABLE 5

Example 3 Data

| | Formulation | | | | Imaging Process Residual Toner | |
|---|---|---|---|---|---|---|
| | Silica Treatment | | γ Large | Free | 56% | 0.7% |
| | Small | Large | Silica | g/m2 | Image | Image |
| Example 3 | DCDMS | PDMS | 25.9 | 0.0096 | 5.7% | 7.5% |
| Comparative Example 3A | DCDMS | HMDS | 28.9 | 0.0090 | 8.2% | 10.0% |

TABLE 5-continued

Example 3 Data

| | Formulation | | | | Imaging Process Residual Toner | |
|---|---|---|---|---|---|---|
| | Silica Treatment | | γ Large | Free | 56% | 0.7% |
| | Small | Large | Silica | g/m2 | Image | Image |
| Comparative Example 3B | DCDMS | None | >81 | 0.0023 | 12.4% | 17.1% |

Example 3 and Comparative Examples 3A and 3B demonstrate the requirement that the surface energy of the surface treatment be below 28 ergs/$cm^2$ for excellent transfer performance. The transfer performance seen for Comparative Example 3A with HMDS treated large silica, although reduced from the inventive example with PDMS treated large silica, is still improved relative to toners made with only small silica as seen in Comparative Example 1A. The large silica with no treatment of Comparative Example 3B is seen to not improve transfer. Example 3 also demonstrates that similar properties may be obtained when surface treating with relatively large particles having low surface energy at a lower temperature in a more energetic mixing process on smaller scale. Approximately equivalent transfer performance and free silica to Example 2C are obtained at 8° C. lower processing temperature, a temperature below the Tg of the toner resin. Comparative Example 3B demonstrates the loss of transfer performance for large silica having higher surface energy treatments extends to low embedment conditions under more intense processing conditions with only a modest reduction in free silica. Comparative Example 3C shows a much greater loss of transfer performance for untreated silica having much higher surface energies but a substantial decrease in free silica.

Example 4

Example 4 toner was made similar to Example 3 toner using a mixture of PR122 and PR 185 and ground to volume median diameter of 6 microns with a specific surface are of 1.3 $m^2/g$ as measured by Kr BET; 1.934 g of toner was mixed with 60 g of NY50L2 (3.0%) and 6 g of R972 (0.3%) and processed until the target temperature of 62° C. was reached in 8 to 10 minutes and processed for an additional 2 minutes at the target temperature. Comparative Example 4A was made the same as Example 4 except that NAX50 was used as the large surface treatment. Comparative Example 4B toner was surface treated with only 2% R972 processed at 56° C. while Comparative Example 4C surface treatment used only 2% RY200S, a 130 $m^2/g$ PDMS treated silica from Evonik, processed at 56° C.

TABLE 6

Example 4 Data

| | Process | Formulation | | | | | Imaging Process Residual Toner | |
|---|---|---|---|---|---|---|---|---|
| | | Silica Treatment | | Concentration | | Free | 56% | 0.7% |
| | Temp | Small | Large | Small | Large | $g/m^2$ | Image | Image |
| Example 4 Area Cov. 34.3% | 62 C. | DCDMS | PDMS | 0.3% | 3% | 0.0062 | 3.0% | 4.3% |
| Comparative Example 4A Area Cov. 36.3% | 62 C. | DCDMS | HMDS | 0.3% | 3% | 0.0061 | 13.6% | 13.8% |

TABLE 6-continued

| Example 4 Data | | | | | | | | |
|---|---|---|---|---|---|---|---|---|
| | | Formulation | | | | | Imaging Process Residual Toner | |
| | Process | Silica Treatment | | Concentration | | Free | 56% | 0.7% |
| | Temp | Small | Large | Small | Large | g/m$^2$ | Image | Image |
| Comparative Example 4B Area Cov. 49.5% | 56 C. | DCDMS | NA | 2% | 0% | NA | 9.7% | 13.5% |
| Comparative Example 4C Area Cov. 45.0% | 56 C. | PDMS | NA | 2% | 0% | NA | 6.0% | 11.7% |

Example 4 demonstrates the use of higher temperatures to compensate for the loss of intense processing conditions when employing smaller toners (in this instance 6 microns volume average particle size) to achieve similar levels of free surface treatment. The 6 micron toner Example 4 transfer residuals and free silica are comparable to the 8 micron toner results of Examples 1 to 3. Example 4 and Comparative Examples 4A, 4B, and 4C demonstrate that low surface energy alone is insufficient to achieve good transfer performance and that large low surface energy surface treatment is required. Comparative Example 4A show a significant loss of transfer performance when HMDS treated large surface treatment is used. Comparative Examples 4B and 4C had no large surface treatment and a high level of small surface treatment processed to obtain a low level of free surface treatment. Comparative Example 4B had poor transfer performance. The transfer performance was only marginally improved by using a small surface treatment with a lower surface energy coating in Comparative Example 4C. It thus appears that large surface treatment and lower surface energy of the large surface treatment are both required for good transfer performance.

Examples 5, 6, and 7

Examples 5, 6, and 7 toners were made similar to Example 4 toner, except increasing proportions of NY90G, a 90 m$^2$/g PDMS treated silica from Evonik, were substituted for NY50L2. The combined levels of NY50L2 and NY90G were kept at 3%, while small silica R972 was used at 0.3% in all samples. Fuser contamination was evaluated as percent of saturation of a fuser roller cleaning web in a NexPress 2500. The lower the cleaning web density, the lower is the toner offset to the fuser roller, and the lower is the potential contamination of components including the fuser roller and metering and donor rollers in the fuser release fluid application device.

TABLE 7

| Examples 4, 5, 6, 7 Data | | | | | | |
|---|---|---|---|---|---|---|
| | | | Example 4 | Example 5 | Example 6 | Example 7 |
| Formulation | Silica Level | 21 nm | 0.3% | 0.3% | 0.3% | 0.3% |
| | | 30 nm | 0% | 1% | 2% | 3% |
| | | 55 nm | 3% | 2% | 1% | 0% |
| | Free g/m$^2$ | | 0.0062 | 0.0039 | 0.0050 | 0.0039 |
| | Toner Cov. | | 34% | 41% | 48% | 55% |
| | Sieve rate | τ s | 51 | 27 | 19 | 11 |
| | | Ret. | 16.2% | 9.4% | 7.0% | 3.8% |
| Imaging Process | Residual Toner | 56% Image | 3.0% | 3.9% | 4.5% | 3.4% |
| | | 0.7% Image | 4.3% | 5.0% | 7.2% | 5.5% |
| | Fuser Cont. | | 62% | 68% | 75% | 86% |

Examples 4, 5, 6, and 7 demonstrate tuning of powder flow and fuser contamination with 30 nm and 55 nm surface treatments while maintaining good transfer performance. Increasing the NY90G content relative to the NY50L2 content results in improving powder flow as seen in the decreasing sieving time constant over the progression of Example 4 to Example 7. There is however an increase in fuser contamination. Examples 4, 5, 6, and 7 demonstrate that the use of combinations of large and intermediate sized surface treatments may be used to obtain powder flow and fuser contamination needed for a given imaging system. Transfer efficiency is good for all of Examples 4, 5, 6 and 7.

The invention claimed is:

1. Toner composition comprising:

resin core particles having outer surfaces, and surface treatment, wherein the surface treatment comprises at least first metal oxide particles having a surface area equivalent average particle diameter of greater than 25 nm and a surface energy of less than or equal to 28 erg/cm$^2$, as determined by methanol wettability midpoint at 22° C., tacked to the outer surfaces of the resin core particles, at a concentration to provide a total projected area of the first metal oxide particles sufficient to cover at least 10% of the resin core particle outer surfaces area, and wherein the toner composition comprises less than 0.013 g non-tacked surface treatment per square meter of resin core particles outer surface.

2. The toner composition of claim 1, wherein the at least first metal oxide particles are tacked to the resin core particles at a concentration sufficient to cover 10 to 65% of the resin core particle outer surfaces area.

3. The toner composition of claim 1, wherein the at least first metal oxide particles are tacked to the resin core particles at a concentration sufficient to cover 15 to 50% of the resin core particle outer surfaces area.

4. The toner composition of claim 1, wherein the at least first metal oxide particles are tacked to the resin core particles at a concentration sufficient to cover 15 to 40% of the resin core particle outer surfaces area.

5. The toner composition of claim 1 wherein said resin core particle are selected from the group consisting of condensation polymers, copolymers of styrene, copolymers of alkyl styrenes with acrylic monomers, polyesters, and mixtures thereof.

6. The toner of claim 1 wherein said resin core particles further comprise charge control agents, waxes or colorants.

7. The toner composition of claim 1 wherein the at least first metal oxide particles are selected from the group consisting of silica, titania and alumina.

8. The toner composition of claim 1 wherein the at least first metal oxide particles have a surface area equivalent average particle diameter of from 30 to 100 nm.

9. The toner composition of claim 1 wherein the at least first metal oxide particles have a surface area equivalent average particle diameter of from 35 to 75 nm.

10. The toner composition of claim 1 wherein the at least first metal oxide particles are silica particles which have been surface coated.

11. The toner composition of claim 10 wherein the surface treatment comprises a coating of polydimethylsiloxane.

12. The toner composition of claim 1, wherein the surface treatment further comprises second metal oxide particles have a surface area equivalent average particle diameter of less than 25 nm.

13. The toner composition of claim 12, wherein the second metal oxide particles have a surface energy of greater than 28 erg/cm$^2$, as determined by methanol wettability at 22° C.

14. The toner composition of claim 12, wherein the surface treatment comprises first metal oxide particles having a surface area equivalent average particle diameter of greater than 35 nm and a surface energy of less than or equal to 28 erg/cm$^2$, as determined by methanol wettability midpoint at 22° C., second metal oxide particles have a surface area equivalent average particle diameter of less than 25 nm, and third metal oxide particles have a surface area equivalent average particle diameter of from 25 to 35 nm.

15. The toner composition of claim 14, wherein the third metal oxide particles have a surface energy of less than or equal to 28 erg/cm$^2$, as determined by methanol wettability at 22° C.

16. The toner composition of claim 1, wherein the toner composition comprises less than 0.010 g non-tacked surface treatment per square meter of resin core particles outer surface.

17. The toner composition of claim 1, wherein the toner composition comprises less than 0.008 g non-tacked surface treatment per square meter of resin core particles outer surface.

18. A developer for developing electrostatic images comprising:

magnetic carrier particles; and toner, wherein said toner comprises:

resin core particles having outer surfaces, and surface treatment, wherein the surface treatment comprises at least first metal oxide particles having a surface area equivalent average particle diameter of greater than 25 nm and a surface energy of less than or equal to 28 erg/cm$^2$, as determined by methanol wettability midpoint at 22° C., tacked to the outer surfaces of the resin core particles, at a concentration to provide a total projected area of the first metal oxide particles sufficient to cover at least 10% of the resin core particle outer surfaces area, and wherein the developer comprises less than 0.013 g non-tacked surface treatment per square meter of resin core particles outer surface, that is free to transfer between the outer surface of the resin core particles and outer surfaces of the magnetic carrier particles.

19. The developer of claim 18, wherein the magnetic carrier particles make up 60 to 99 weight percent of the developer; and the toner makes up 1 to 40 weight percent of the developer, and further wherein the surface treatment comprises at least first metal oxide particles having a surface area equivalent average particle diameter of from 30 to 100 nm, at a concentration to provide a total projected area of the first metal oxide particles sufficient to cover 10 to 65% of the resin core particle outer surfaces area, and wherein the developer comprises less than 0.010 g non-tacked surface treatment per square meter of resin core particles outer surface, that is free to transfer between the outer surface of the resin core particles and outer surfaces of the magnetic carrier particles.

20. The developer of claim 19, wherein the magnetic carrier particles comprise strontium ferrite.

* * * * *